US006102719A

United States Patent [19]

Tung

[11] Patent Number: 6,102,719

[45] Date of Patent: Aug. 15, 2000

[54] CARD CONNECTOR

[75] Inventor: Shun-Chi Tung, Tu-Chen, Taiwan

[73] Assignee: Hon Hai Precision Ind. Co., Ltd., Taipei Hsien, Taiwan

[21] Appl. No.: 09/114,444

[22] Filed: Jul. 13, 1998

[30] Foreign Application Priority Data

Jul. 11, 1997 [TW] Taiwan ..... 86211660
Jul. 11, 1997 [TW] Taiwan ..... 86211661

[51] Int. Cl.[7] ..... H01R 13/62

[52] U.S. Cl. ..... 439/159

[58] Field of Search ..... 439/159; 361/798, 361/754

[56] References Cited

U.S. PATENT DOCUMENTS 5,275,573 1/1994 McCleerey ..... 439/159
5,383,789 1/1995 Watanabe ..... 439/159
5,421,737 6/1995 Chen et al. ..... 439/157
5,492,481 2/1996 Lewis ..... 439/159
5,507,658 4/1996 Ho ..... 439/159
5,588,850 12/1996 Pan et al. ..... 439/92
5,899,763 5/1999 Kajiura ..... 439/159

*Primary Examiner*—Lincoln Donovan
*Assistant Examiner*—Briggitte Hammond

[57] ABSTRACT

A card connector has a housing from two ends of which an engaging member extends, via which a fixing member is connected to the housing. An ejection plate is movably positioned on a flat portion of the fixing member and comprises a driving end pivotably connected to one end of a handle bar which a user can push to move the handle bar which, in turn, moves the driving end, an ejection tab formed at a distal end of the flat portion and abutting against an inserted card, and a plurality of fulcrum protrusions between the driving end and ejection tab of the ejection plate. A lever operation of the ejection plate is provided by using the driving end as a driving point, the ejection tab abutting against the inserted card as a loading point, and the fulcrum protrusions sequentially functioning as a fulcrum during the lever operation.

11 Claims, 13 Drawing Sheets

10
100
100'
102
110
111
11
101
1216
1211
1214
1215
1212
131
132
133
13
1213
1217
121
1225
1220
1222
1223
1224
1241
1242
124
12
122
1226
1230
1232
1233
123
1234
1231
1

CARD CONNECTOR

BACKGROUND OF THE INVENTION

1. Field of the Invention

The present invention relates to a card connector, and particularly to a card connector which includes at least two fulcrums so that an inserted card can be withdrawn from the card connector quickly and conveniently.

2. The Prior Art

Portable computer are generally installed with card connectors for reception/withdrawal of cards. These card connectors generally have an ejector mechanism for withdrawal of a card (or cards) therefrom. Referring to FIG. 1, a conventional card connector 5 comprises a housing 50, an engaging member 51 including legs 511 extending from the housing 50 and a metal shielding plate 510, and an ejector mechanism 52. The ejector mechanism 52 comprises a guiding frame 521, an ejection plate 522, a lever 523, and a handle bar 524. The guiding frame 521 has two parallel portions respectively connected to two ends of the housing 50 thus forming two sides of the connector 5. The ejection plate 522 is movably positioned on a top surface of the housing 50. An engaging member 5221 projects from the ejection plate 522 for pivotable engagement with a hole 5231 defined in the lever 523. The lever 523 is positioned on the ejection plate 522 which is further positioned on the shielding plate 510. A hole 5232 defined in the lever 523 is in alignment with a hole 5101 defined in the shielding plate 510. A relatively big hole 5222 defined in the ejection plate 522 allows a rivet (not shown) or the like to pivotably connect the hole 5232 of the lever 523 and the hole 5101 of the meal shielding plate 510 without being blocked by the physical portion of the ejection plate 522. One end of the lever 523 is pivotably connected to a yoke and 5241 of the handle bar 524. The handle bar 524 is slidably received in an outer channel of the guiding frame 521 and is operated to move back and forth in the outer channel for driving the ejection plate 522 via the lever 523 to move back and forth so as to eject an inserted card (not shown) from the housing 50. The guiding frame 521 includes an inner channel which allows the card to slide into and out of the housing 50.

Also referring to FIG. 2, during ejection of a card 60 a handle portion 5242 of the handle bar 524 is depressed in a direction toward the housing 50. The hole 5232 of the lever 523 is a fulcrum, the end of the lever 523 engaged with the yoke end 5241 of the handle bar 524 is a driving point, and the pivoting portion 5231 is a loading point, thereby ejecting the card 60 from the housing 50. With this structure, a driving arm length F is greater than a loading arm length R. However, since the fulcrum thereof (the connection structure of the holes 5232, 5101 and the unshown rivet) is the only fulcrum to absorb the force in the lever mechanism, the rivet is apt to be damaged or deformed after extended use. Another drawback is that due to the single fulcrum, the handlebar 524 requires a relatively long sliding length to eject the card out of the housing 50 thus the handle bar 524 needs to slide a relatively long distance which also results in an increased size of the connector. Therefore, to develop an extended life and compact size of the connector, a new structure is earnestly required to replace the single fulcrum structure of the ejector mechanism 52.

SUMMARY OF THE INVENTION

The primary objective of the present invention is to provide a card connector which includes an improved ejector mechanism for properly and quickly ejecting an inserted card.

Another objective of the present invention is to provide a card connector which utilizes a multi-fulcrum structure to eject an inserted card.

In accordance with one aspect of the present invention, a card connector comprises a housing from which an engaging member extends, an ejector mechanism comprising a fixing frame engaging with the housing via the engaging member, a guiding frame engaging with the fixing frame and including an outer channel, an ejection plate comprising a driving end and an ejection tab at two distal ends thereof respectively, and a first fulcrum protrusion and a second fulcrum protrusion between the driving end and the ejection tab, and a handle bar movably retained in the outer channel of the guiding frame and pivotably engaging with the driving end of the ejection plate. The ejection plate is movably mounted on a portion of the guiding frame with the driving end thereof being a driving point of a lever operation, the ejection table being a loading point of the lever operation abutting against an inserted card, and the first fulcrum protrusion and the second fulcrum protrusion sequentially functioning as a fulcrum of the lever operation.

In accordance with another aspect of the present invention a card connector comprises: a housing from which an engaging member extends, an ejector mechanism comprising a fixing frame engaging with the housing via the engaging member, a guiding frame engaging with the fixing frame and including an outer channel, an ejection plate comprising a driving end and an ejection tab at two distal ends thereof respectively, and a first fulcrum protrusion, a second fulcrum protrusion, and a third fulcrum protrusion between the driving end and the ejection tab, and a handle bar movably retained in the outer channel of the guiding frame and pivotably engaging with the driving end of the ejection plate. The ejection plate is movably mounted on a portion of the guiding frame with the driving end thereof being a driving point of a lever operation, the ejection tab being a loading point of the lever operation abutting against an inserted card, and the first, second and third fulcrum protrusions sequentially functioning as a fulcrum of the lever operation.

DETAILED DESCRIPTION OF THE PREFERRED EMBODIMENTS

Figure 1:
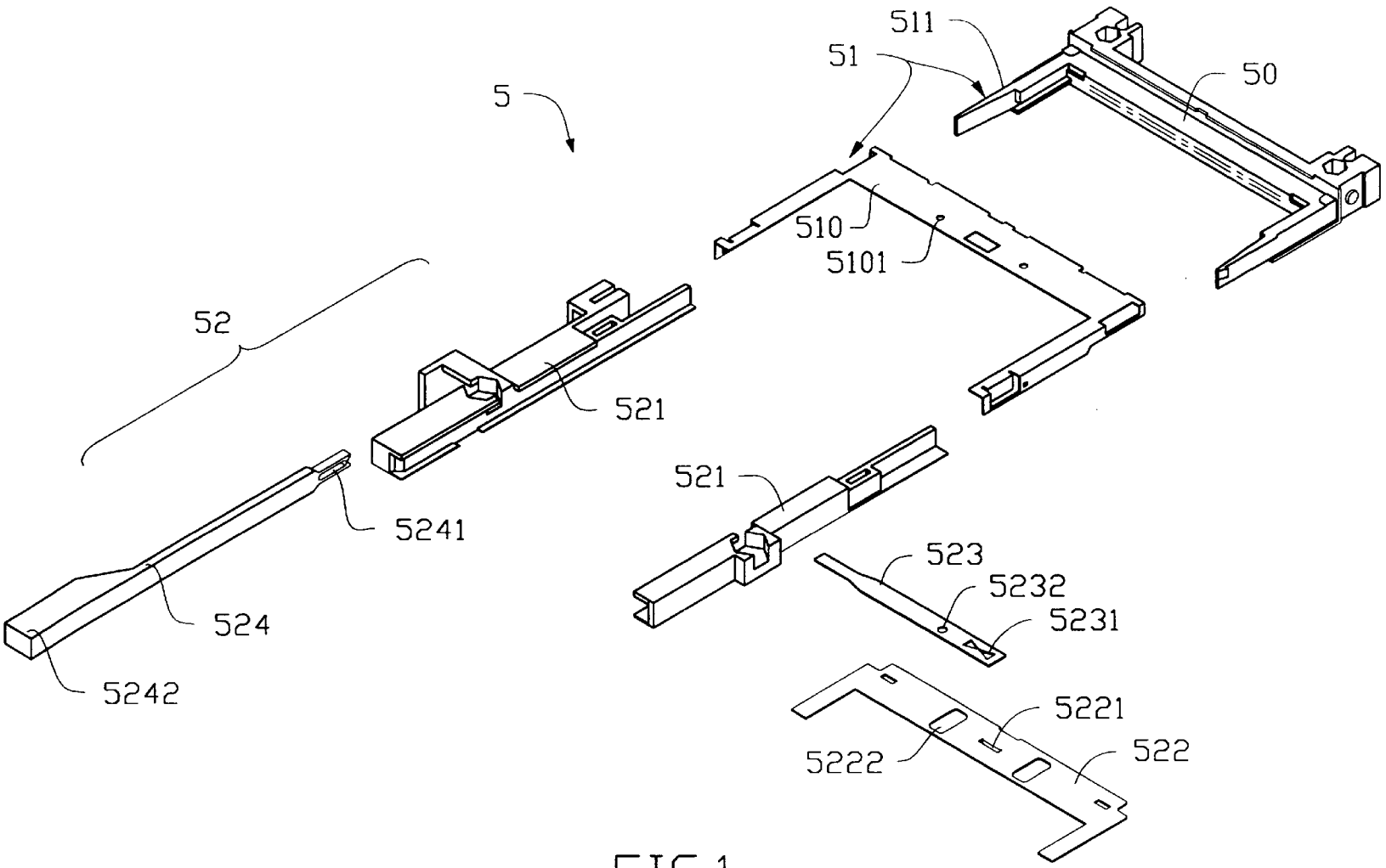
FIG. 1 is an exploded view of a conventional card connector.
Figure 2:
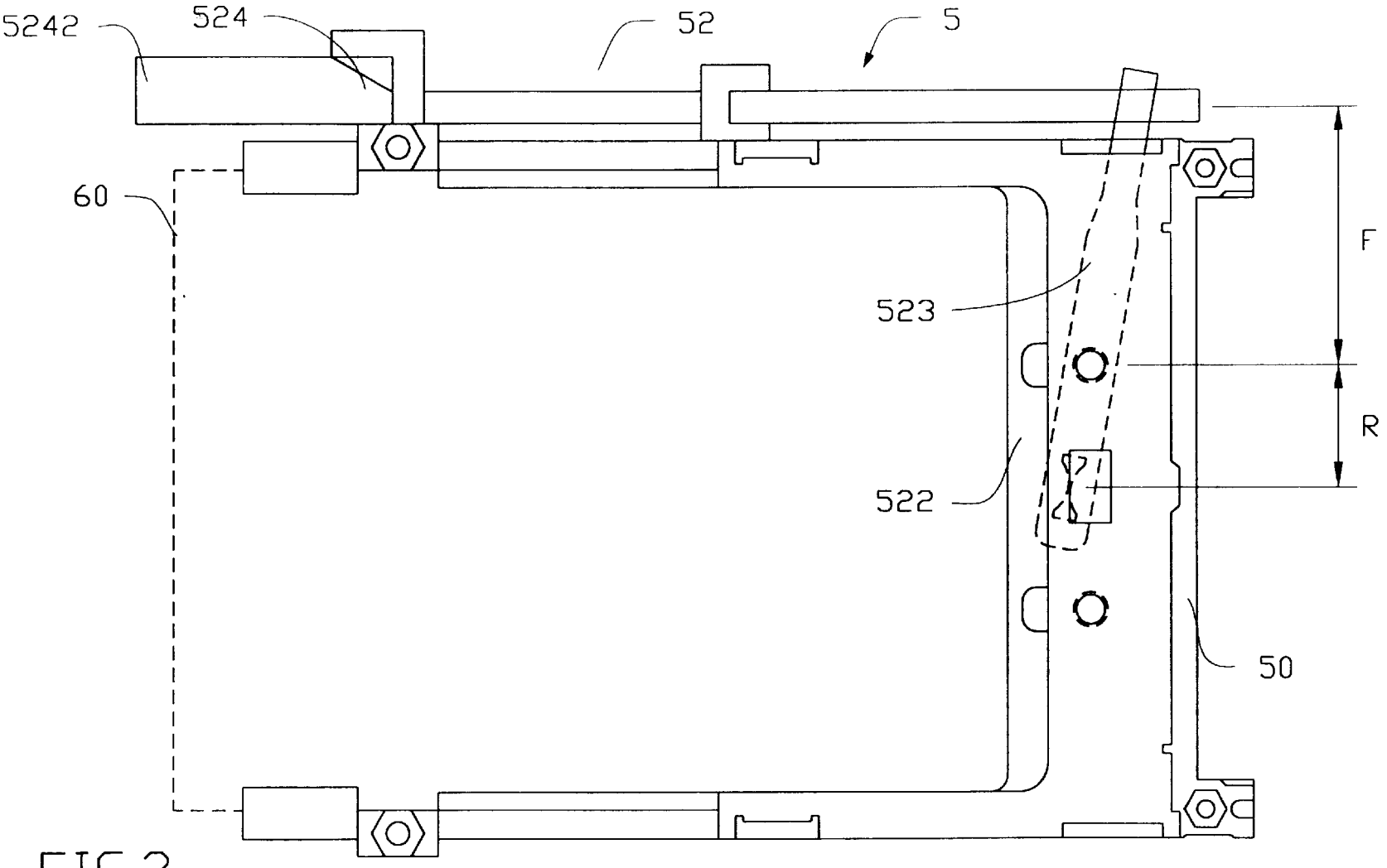
FIG. 2 is a schematic plan view of an assembly of FIG. 1.
Figure 3:
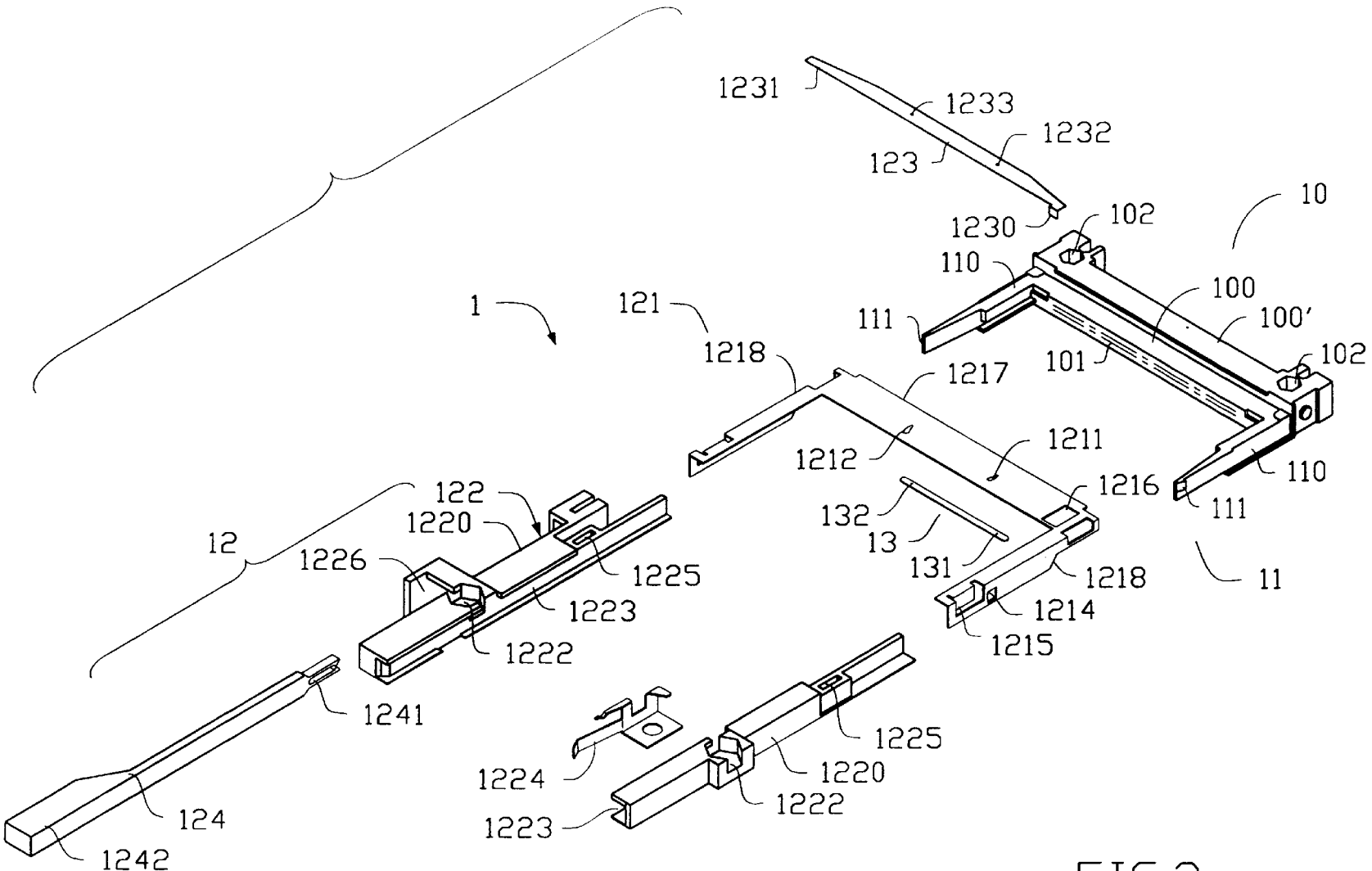
FIG. 3 is an exploded view of a card connector in accordance with the present invention.

Referring to FIG. 3, a card connector 1 in accordance with the present invention comprises a housing 10, an engaging device 11 and an ejector mechanism 12. The housing 10 defines a lower surface 100 connected to an upper surface 100', whereby the lower surface 100 provides space for receiving other members which will be explained later. A plurality of contacts 101 are retained in the housing 10 for electrically engaging with an electrical card (not shown). Two locking holes 102 are formed at two ends of the housing 10 allowing bolts (not shown) or the like to lock the card connector 1 onto a printed circuit board (not shown). The engaging device 11 comprises two parallel bars 110 extending perpendicularly from two ends of the housing 10. The parallel bars 110 each have a tapered protrusion 111 for engagement with the ejector mechanism 12 which will be explained later.

The ejector mechanism 12 comprises a fixing frame 121 engaging with the housing 10 via the engaging device 11, a guiding frame 122 engaged with the fixing frame 121, an ejection plate 123 movably mounted on the fixing frame 121 via engagement with a positioning plate 13 below the fixing frame 121, and a handle bar 124 movably retained in a portion of the guiding frame 122.

The fixing frame 121 is a U-shaped structure comprising two parallel side portions 1218 interconnected via an intermediate portion 1217. The intermediate portion 1217 is a plate which defines a slot 1216 proximate a distal end thereof and a first fulcrum hole 1211 and a second fulcrum hole proximate a middle portion thereof. Each side portion 1218 defines an engaging hole 1214 and forms an engaging tab 1215. The parallel bars 110 of the engaging device 11 are engaged with the fixing frame 121 with the tapered protrusions 111 thereof being received and retained in the two engaging holes 1214 of the fixing frame 121.

The guiding frame 122 comprises two guiding bars 1220 each of which is defined with an inner channel 1223 and an engaging slit 1225. The fixing frame 121 is engaged with the guiding frame 122 with the engaging tabs 1215 thereof being received and retained in the two engaging slits 1225 of the guiding frame 122. An outer channel 1226 is formed on one of the two guiding bars 1220 for slidably receiving the handle bar 124. More specifically, the handle bar 124 comprises a handle 1242 and a yoke and 1241 at respective ends thereof. The handle 1242 is wider than other portions of the handle bar 124 for facilitating operation by a user. The yoke end 1241 is formed to engage with the ejection plate 123 which will be explained later. A locking hole 1222 is formed in each of the two guiding bars 1220 allowing a pair of nuts and bolts (not shown) to fix the connector on a related printed circuit board. A grounding member 1224 made from a metal plate is fixed in the inner channel 1223 for creating a grounding contact with the inserted card in order to suppress noise during insertion of the card into the card connector 1.

The positioning plate 13 defines first and second riveting holes 131, 132 for engaging with the ejection plate 123 which will be explained later.

Figure 4:
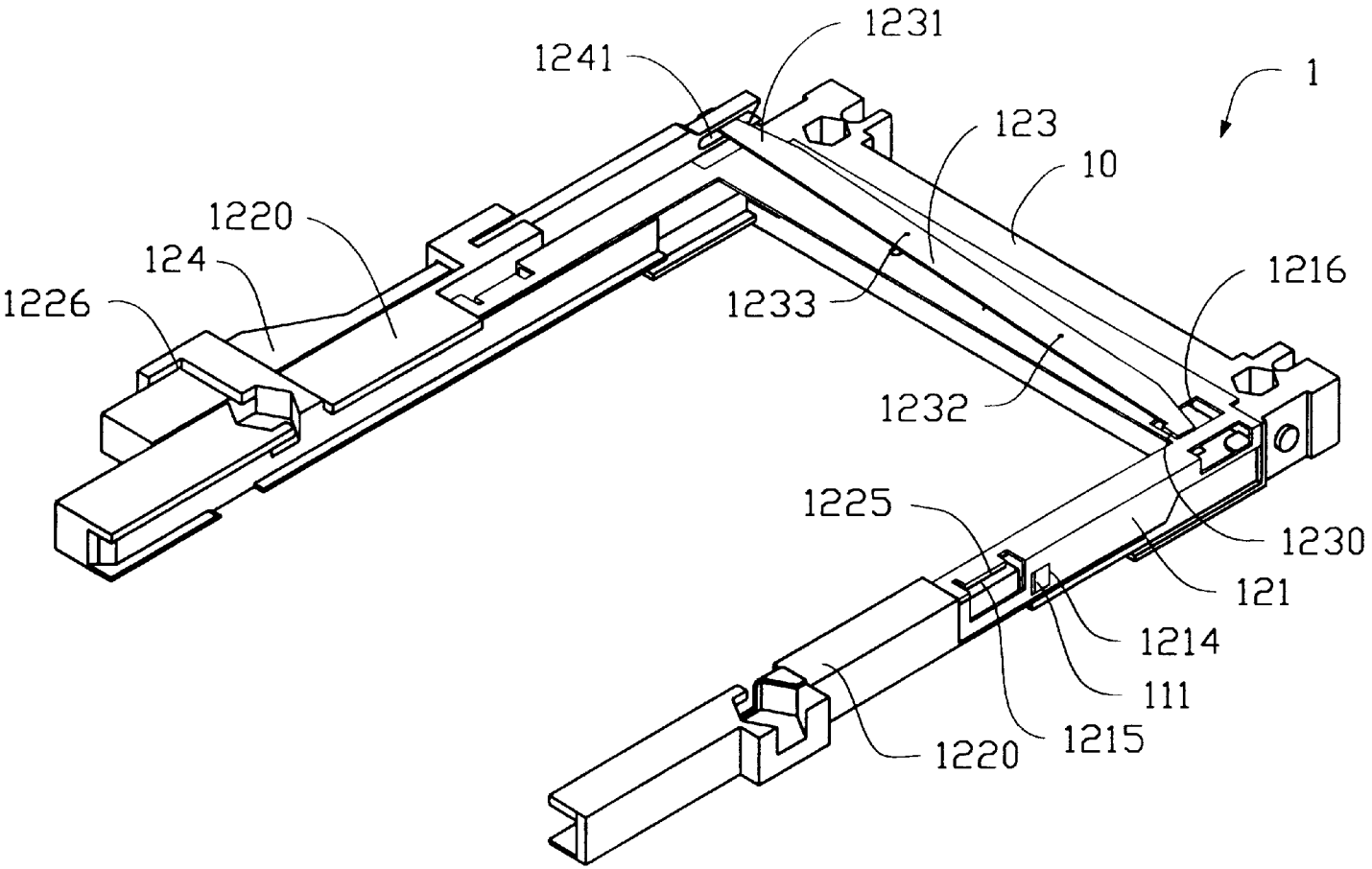
FIG. 4 is an assembled view of FIG. 3.

The ejection plate 123 is an elongate plate comprising a driving end 1231 pivotably retained in the yoke 1241 of the handle bar 124. The ejection plate 123 is pivotably moved back and forth on the intermediate portion 1217 of the fixing frame 121 when the handle bar 124 if manually moved back and forth in the outer channel 1226 of the guiding frame 122. An ejection tab 1230 extends downward from a free end of the ejection plate 123. First and second fulcrum protrusions 1232, 1233 projecting downward form the ejection plate 123 respectively extend through the first and second fulcrum holes 1211, 1212 and then receivably engage with the first and second riveting holes 131, 132 of the positioning plate 13. With the assembly shown in FIG. 4, the ejection plate 123 is pivotably driven by the handle bar 124 to exhibit a lever operation at the intermediate portion 1217 of the fixing frame 121.

Figure 5A:
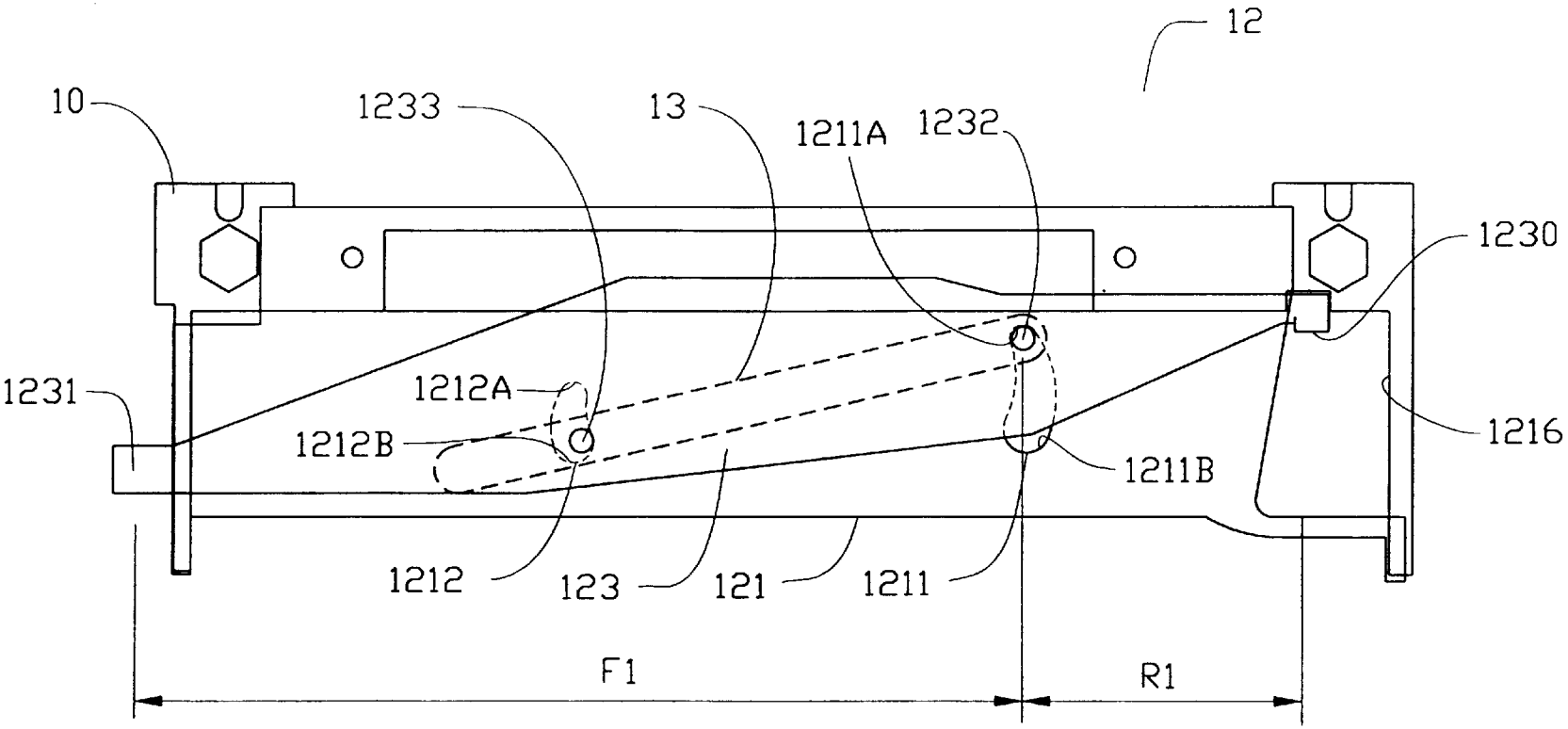
FIG. 5A is a schematic view showing an ejector mechanism of the card connector of the present invention is prepared to eject a card (not shown) retained in the card connector, wherein a first fulcrum is determined to be the fulcrum of a lever mechanism.
Figure 5B:
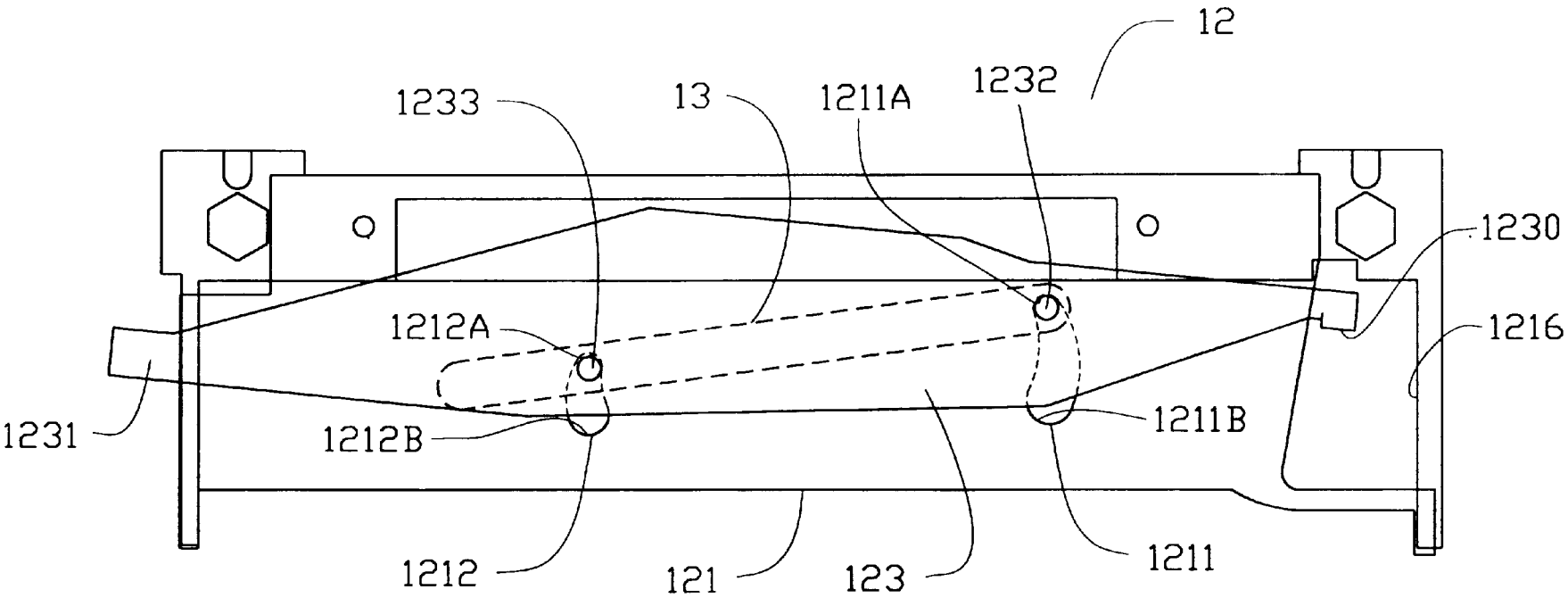
FIG. 5B is similar to FIG. 5A except that the fulcrum of operations changes from a first fulcrum to a second fulcrum.
Figure 5C:
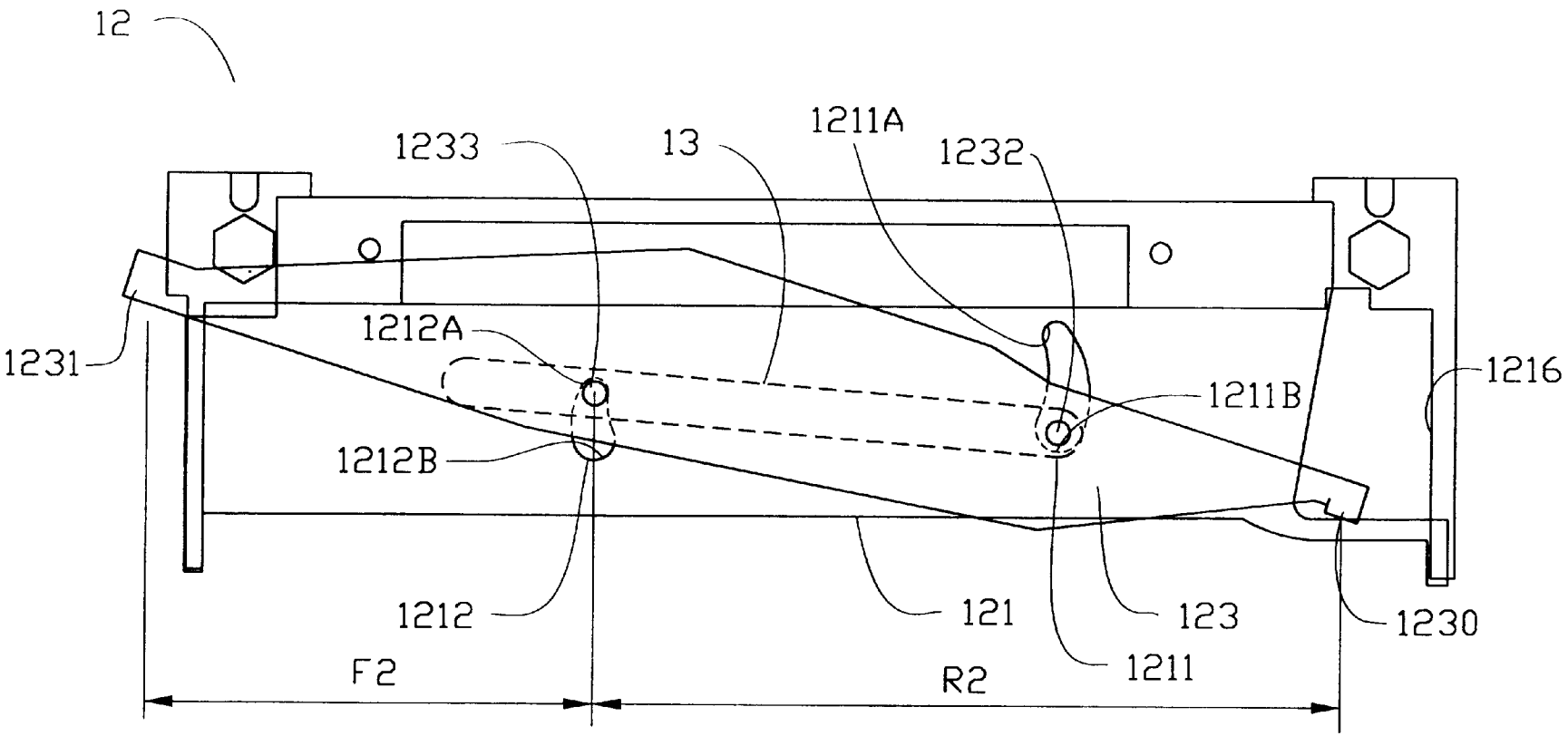
FIG. 5C illustrates that the ejector mechanism of FIG. 5B has fully ejected the card.

Details of the lever operation of the ejection plate 123 are shown in referred to FIGS. 5A to 5C. Particularly referring to FIG. 5A, the first and second fulcrum holes 1211, 1212 are elliptical and sized to be greater than the cross-sections of the first and second fulcrum protrusions 1232, 1233, therefore the fulcrum protrusions 1232, 1233 can respectively move within the first and second fulcrum holes 1211, 1212.

For explaining the lever operation of the ejection plate 123, a leading edge and a lagging edge of the first and second fulcrum holes 1211, 1212 are respectively defined with respect to the upper surface 100' of the housing 10. A leading edge 1211A and a lagging edge 1211B of the first fulcrum hole 1211 are defined at axial ends of the elliptical hole, with the leading edge 1211A being more proximate to the upper surface 100' than the lagging edge 1211B. Similarly, leading and lagging edges 1212A, 1212B are defined at axial ends of the second fulcrum hole 1212. The leading edge 1211A of the first fulcrum hole 1211 is more proximate to the upper surface 100' than the leading edge 1212A of the second fulcrum hole 1212.

FIG. 5A illustrates that the driving end 1231 of the ejection plate 123 is located at the most lagging position (farthest position) with respect to the upper surface 100'. During this first status, the handle bar 124 may be pushed to move in the outer channel 1226 proximate the upper surface 100', which in turn drives the ejection plate 123 to exhibit a lever operation, with the first fulcrum protrusion 1232 abutting against the leading edge 1211A of the first fulcrum hole 1211 and functioning as a fulcrum for the lever operation, the ejection tab 1230 moving far away with respect to the upper surface 100' in order to eject a card received in the connector 1, and the second fulcrum protrusion 1233 moving into the leading edge 1212A of the second fulcrum hole 1212. The first fulcrum protrusion 1232 functions as a fulcrum of the lever operation until the second fulcrum protrusion 1233 moves to abut against the leading edge 1212A of the second fulcrum hole 1212 as shown in FIG. 5B.

During the first status as shown in FIGS. 5A to 5B, a first driving arm length F1 is defined by an effectively lateral distance from the driving end 1231 to the first fulcrum protrusion 1232 of the ejection plate 123, while a first loading arm length R1 is defined by an effectively lateral distance from the first fulcrum protrusion 1232 to the ejection tab 1230 of the ejection plate 123. During the first status, the first driving arm length F1 is much longer than the first loading arm length R1, therefore the retention strain between the inserted card and the housing 10 can be easily released due to the large arm ratio of the driving arm length to the loading arm length. After the retention strain between the card and the housing 10 is released during the first status, the lever operation proceeds to a second status during which the lever operation merely needs to push the weight of the card without the retention strain, therefore the driving arm length and the loading arm length may vary for quick rejection of the card from the connector 1 rather than for conserving energy.

FIGS. 5B to 5C illustrate the operation of the ejection plate 123 during the second status of the lever operation, wherein the handle bar 124 may be further moved to be more proximate to the upper surface 100', which in turn drives the ejection plate 123 to have a lever operation, with the second fulcrum protrusion 1233 abutting against the leading edge 1212A of the second fulcrum hole 1212 and functioning as a fulcrum for the lever operation, the ejection tab 1230 continuing to move further away with respect to the upper surface 100' in order to push the card already released from the housing 10, and the first fulcrum protrusion 1232 moving into the lagging edge 1211B of the first fulcrum hole 1211. The second fulcrum protrusion 1233 functions as a fulcrum of the lever operation until the card is fully ejected from the connector as shown in FIG. 5C. During the second status as shown in FIG. 5C, a second driving arm length F2 is defined by an effectively lateral distance from the driving end 1231 to the second fulcrum protrusion 1233 of the ejection plate 123, while a second loading arm length R2 is defined by an effectively lateral distance from the second fulcrum protrusion 1233 to the ejection tab 1230 of the ejection plate 123. During the second status the second driving arm length F2 is much shorter than the second loading arm length R2, therefore the card already released from retention with the housing 10 can be fully and quickly ejected from the connector 1.

Figure 6:
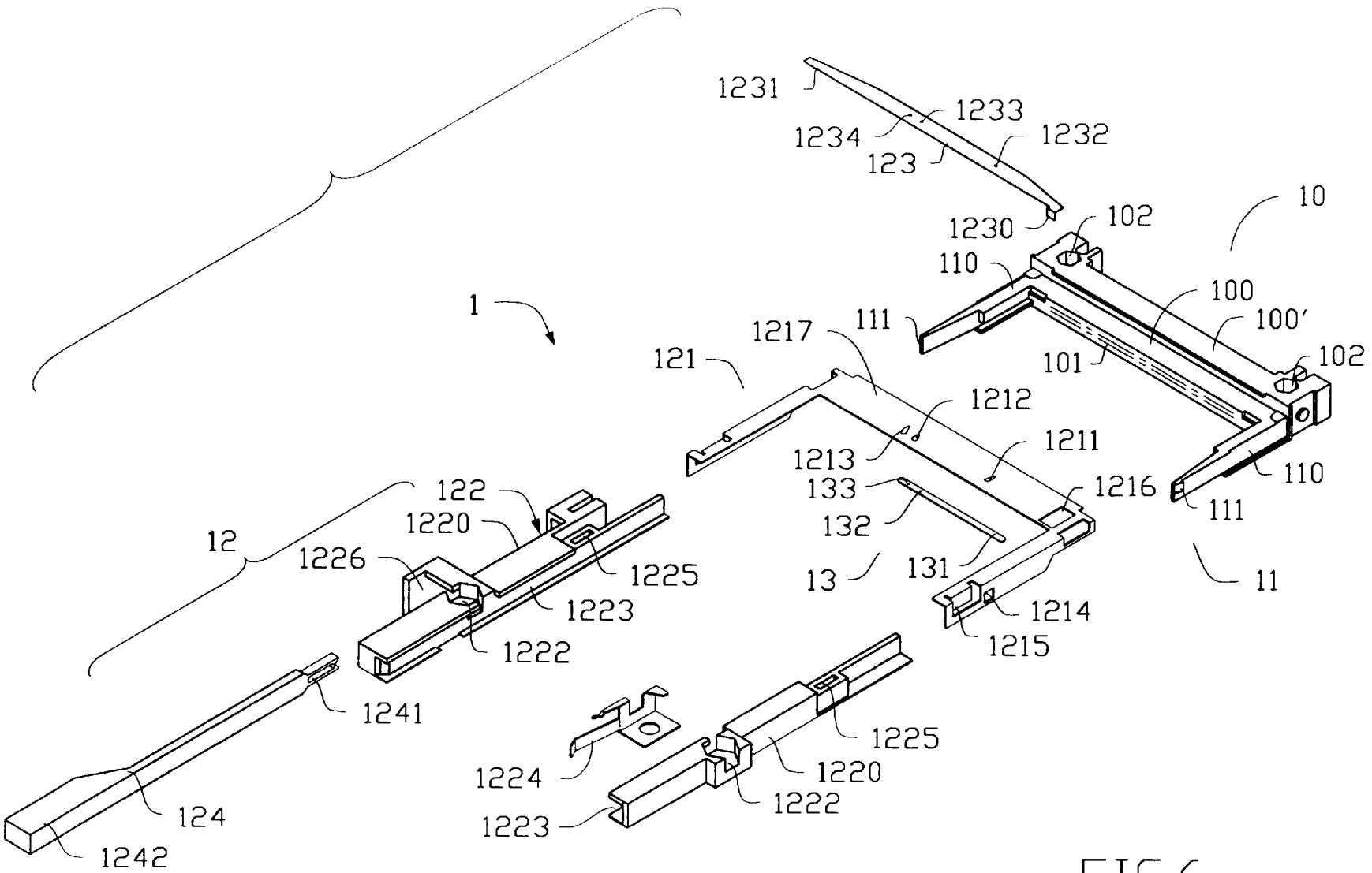
FIG. 6 is an exploded view of a second embodiment in accordance with the present invention.
Figure 7:
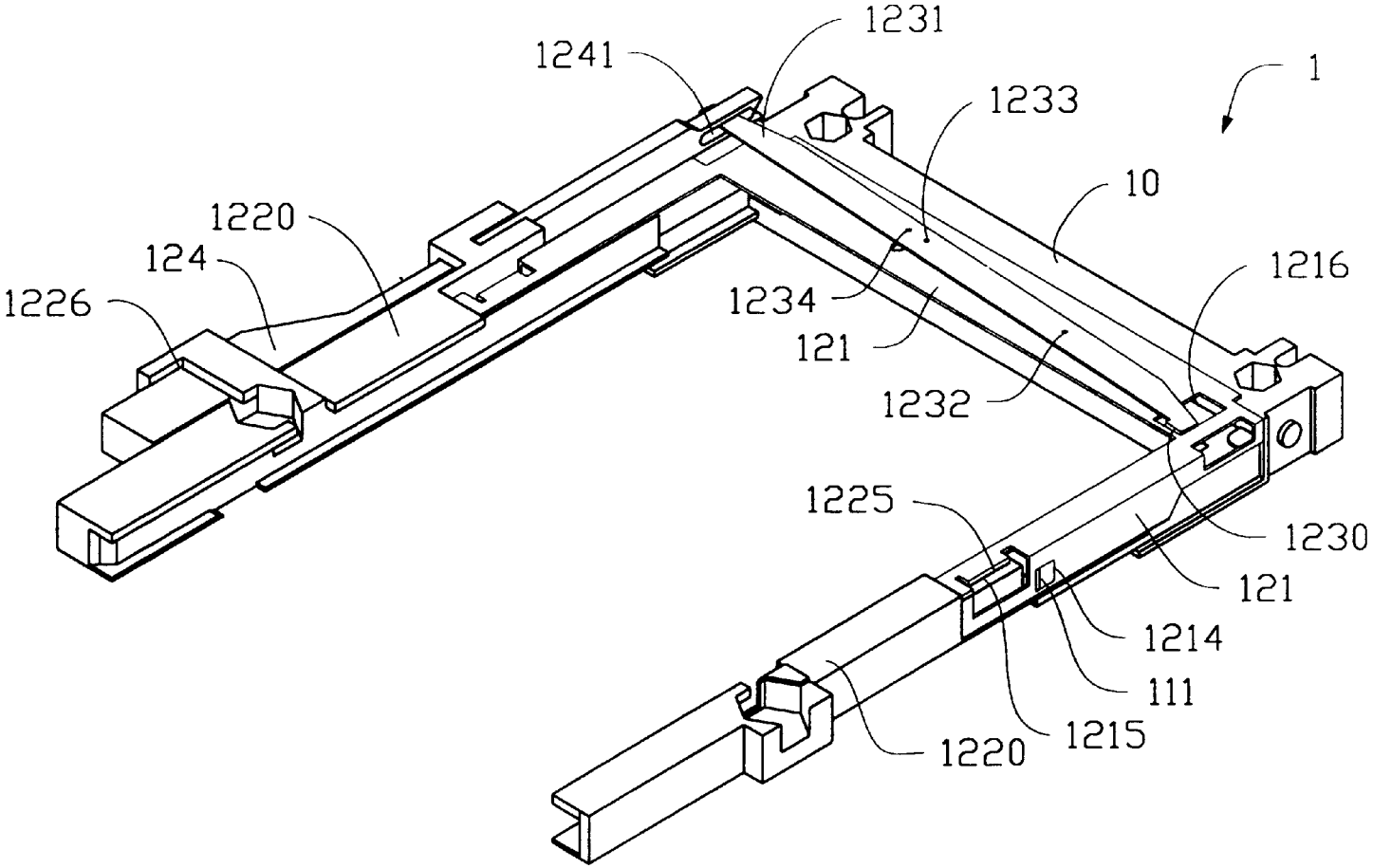
FIG. 7 is an assembled view of FIG. 6.

A second embodiment of the present invention is illustrated in FIGS. 6 to 8D. In the second embodiment an additional fulcrum is introduced so as to more effectively utilize the multi-fulcrum idea. In the second embodiment most of the components are exactly the same as those disclosed in the first embodiment except for the intermediate portion 1217 of the fixing frame 121, the ejection plate 123, and the positioning plate 13. A third fulcrum hole 1213 is additionally defined in the fixing frame 121 of the first embodiment. Similar to the first and second fulcrum holes 1211, 1212, the third fulcrum hole 1213 is an elliptical hole defining a leading edge 1213A and a lagging edge 1213B at two ends thereof. Referring to FIG. 6, a third fulcrum protrusion 1234 is additionally formed on the ejection plate 123 whereby the first, second, and third protrusions 1232, 1233, 1234 are sequentially arranged in a line. The assembly of FIG. 6 is shown in FIG. 7 which is similar to the assembly view of FIG. 4 except that an additional fulcrum protrusion 1234 is shown.

Figure 8A:
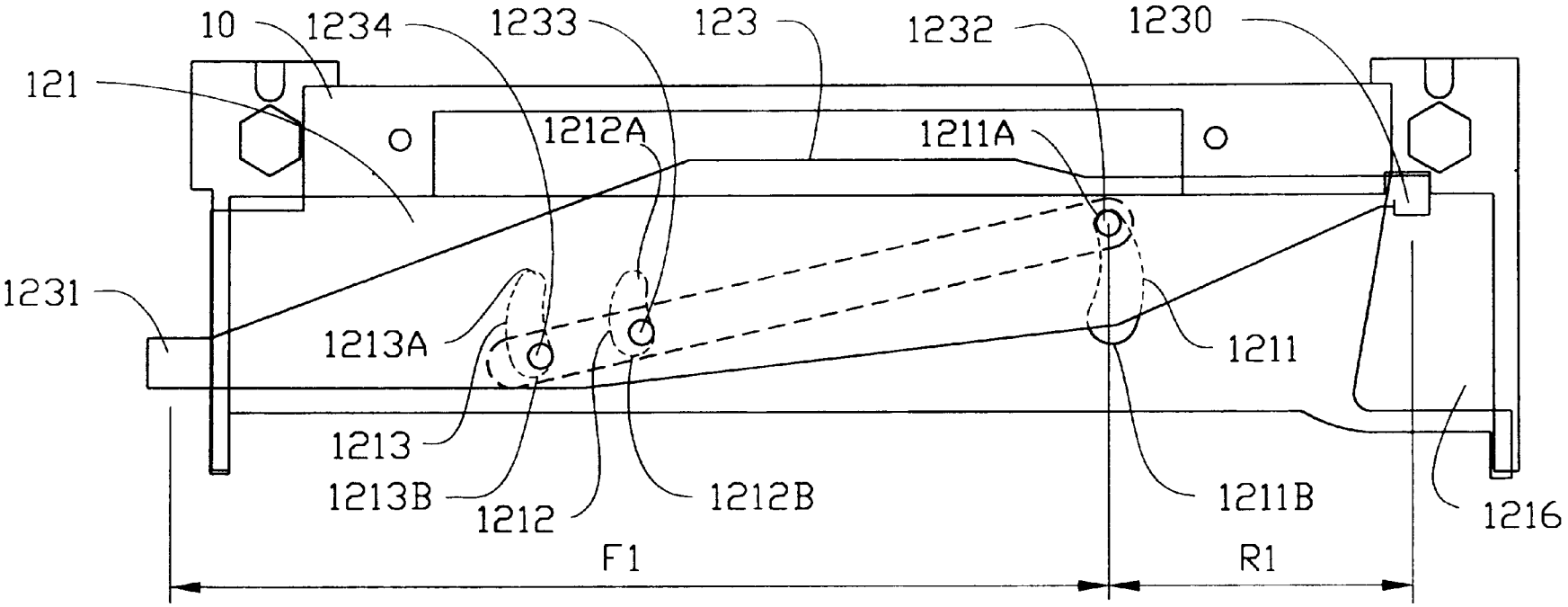
FIG. 8A is a schematic view showing an ejector mechanism of the card connector of the present invention is prepared to eject a card (not shown) retained in the card connector, wherein a first fulcrum is determined to be the fulcrum of a lever mechanism.
Figure 8B:
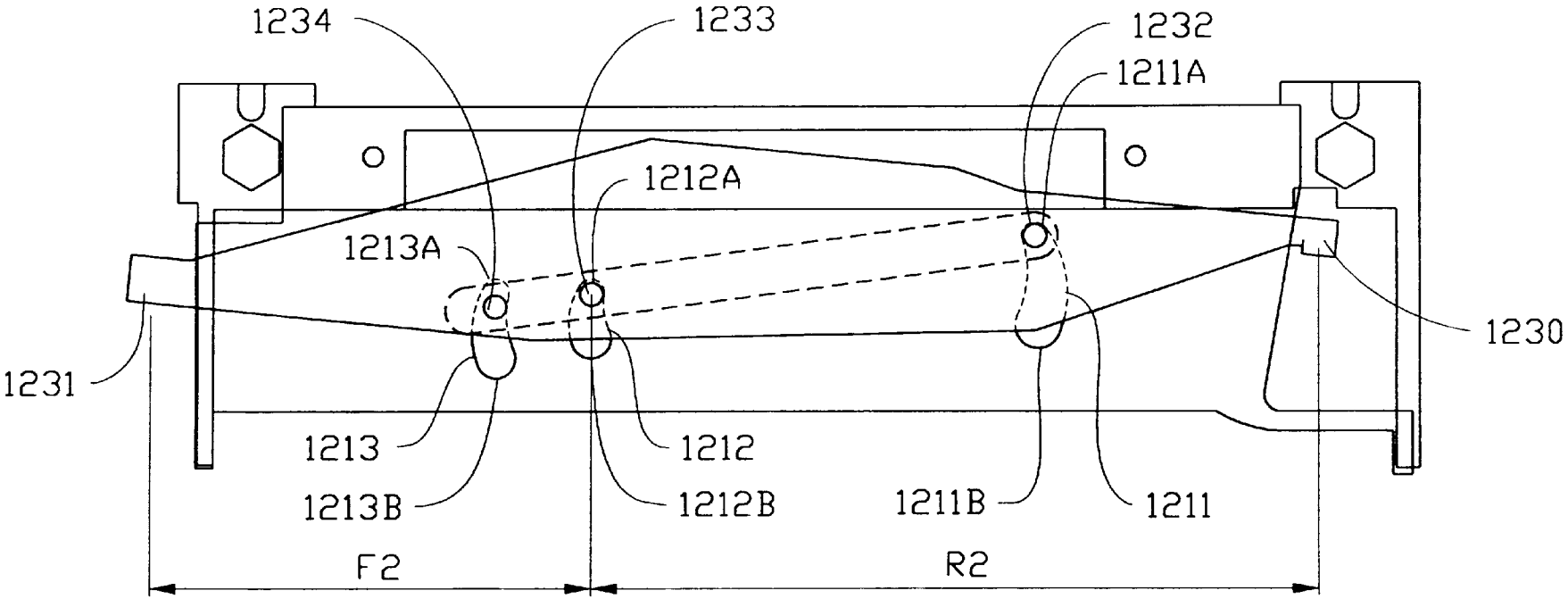
FIG. 8B is similar to FIG. 8A except that the fulcrum of operations changes from a first fulcrum to a second fulcrum.

FIGS. 8A to 8B illustrate the lever operation in a first status in which the first fulcrum protrusion 1232 functions as the fulcrum of the lever operation, the ejection tab 1230 moves away from the upper surface 100' to release the engagement between the card and the housing 10, and the second fulcrum protrusion 1233 moves to abut against the leading edge 1212A of the second fulcrum hole 1212. It should be noted that the distance of movement of the ejection tab 1230 during the first status of the second embodiment is the same as during the first status of the first embodiment.

Figure 8C:
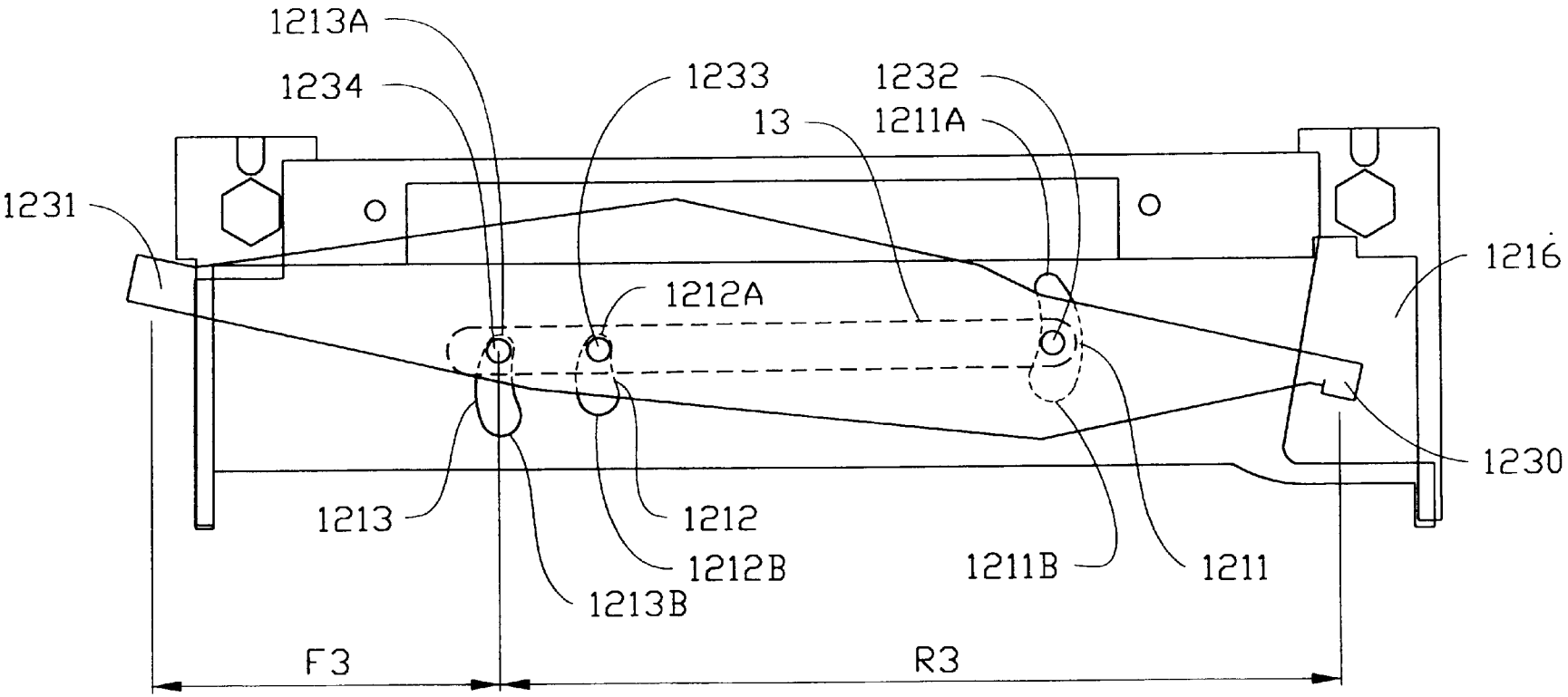
FIG. 8C is similar to FIG. 8B except that the fulcrum of operations changes from the second fulcrum to a third fulcrum.
Figure 8D:
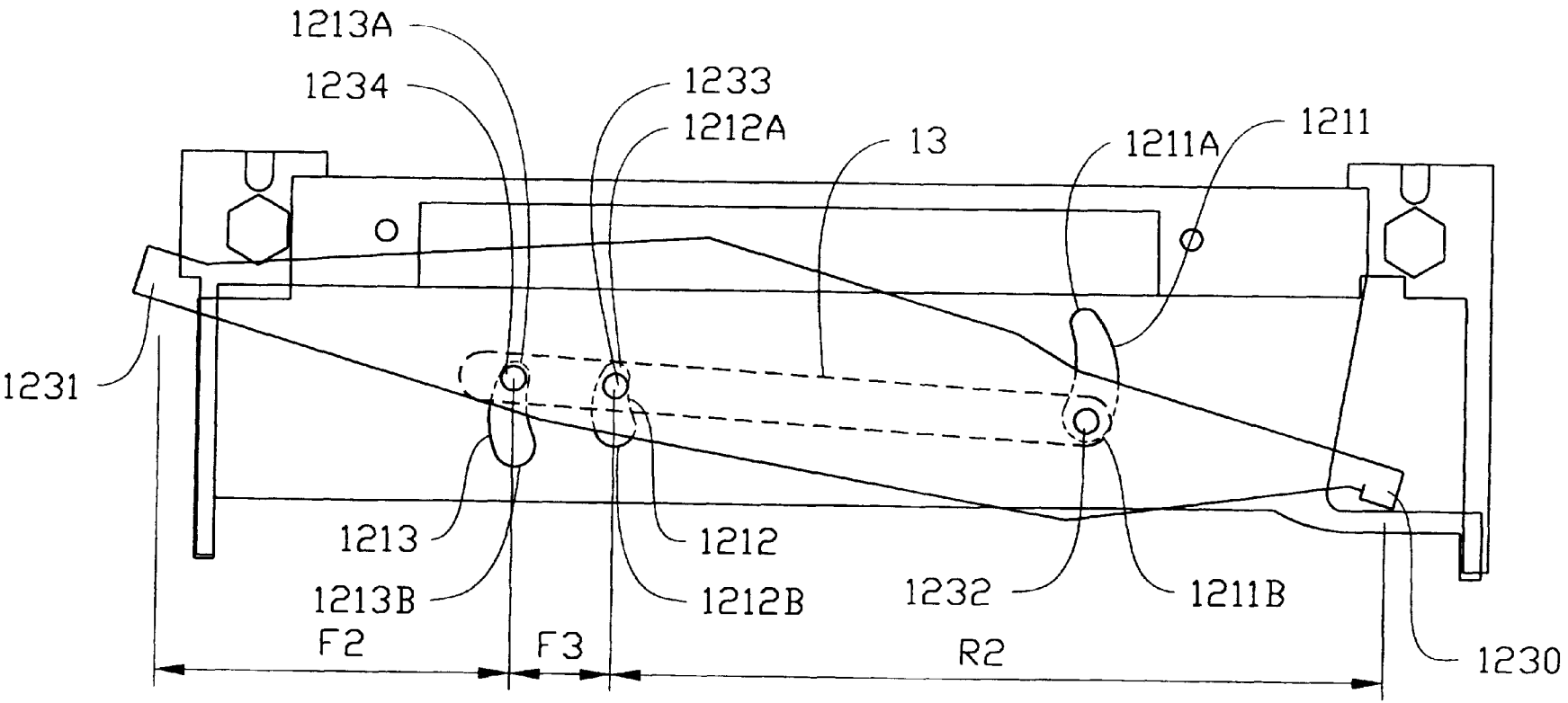
FIG. 8D illustrates that the ejector mechanism of FIG. 8C has fully ejected the card.

From FIGS. 8B to 8C, the card is continuously ejected from the connector 1 by changing the fulcrum of the lever operation from the first fulcrum protrusion 1232 to the second fulcrum protrusion 1233 similar to the operation described in FIGS. 5B and 5C. However, for quicker ejection of the card from the connector 1, a third status replaces the second status in which the third fulcrum protrusion 1234 replaces the second fulcrum protrusion 1233 to be the fulcrum of the lever operation before the card is fully ejected from the connector 1 as shown in FIGS. 8C and 8D. It should be noted that the distance of movement of the ejection tab 1230 during the second and third status of the second embodiment is the same as during the second status of the first embodiment. Referring to FIGS. 8C and 8B, a ratio of a third driving arm length F3 to a third loading arm length R3 is greater than the ratio of the second driving length F2 to the second loading arm length R2. Therefore, the ejection speed during the third status is quicker than during the second status. Therefore, with the second embodiment, a user can eject a card from the connector quicker than in the first embodiment.

While the present invention has been described with reference to specific embodiments, the description is illustrative of the invention and is not to be construed as limiting the invention.

Therefore, various modifications to the present invention can be made to the preferred embodiments by those skilled in the art without departing from the true spirit and scope of the invention as defined by the appended claims.

What is claimed is:

1. A card connector comprising:

a housing from which an engaging member extends; and an ejector mechanism comprising a fixing frame engaging with the housing via the engaging member, a guiding frame engaging with the fixing frame and including an outer channel, an ejection plate being movably mounted to the guiding frame and comprising a driving end and an ejection tab at two distal ends thereof and a first fulcrum protrusion and a second fulcrum protrusion between the driving end and the ejection tab, and a handle bar movably retained in the outer channel of the guiding frame and movably engaging with the driving end of the ejection plate;

wherein the ejection plate is rotatably mounted on a portion of the fixing frame, the ejection tab abuts against an inserted card, and the first fulcrum protrusion and the second fulcrum protrusion sequentially function as two fulcrums of two lever operations to firstly disengage the inserted card from the card connector at a low operating force and then quickly eject the inserted card from the card connector.

2. The card connector as claimed in claim 1, wherein the fixing frame is substantially a U-shaped structure comprising two parallel side portions and an intermediate portion guidingly supporting the ejection plate.

3. The card connector as claimed in claim 2, wherein the intermediate portion of the fixing frame defines a first fulcrum hole and a second fulcrum hole and the first and second fulcrum protrusions of the ejection plate are movably retained in the first and second fulcrum holes, respectively.

4. The card connector as claimed in claim 3, wherein the intermediate portion of the fixing frame defines a slot proximate a distal end thereof for movably receiving the ejection tab of the ejection plate therein.

5. The card connector as claimed in claim 4, wherein a positioning plate is provided under the intermediate portion of the fixing frame and defines a first riveting hole and a second riveting hole rivetably engaging with the first and second fulcrum protrusions of the ejection plate, respectively.

6. A card connector comprising:

a housing from which an engaging member extends; and an ejector mechanism comprising a fixing frame engaging with the housing via the engaging member, a guiding frame engaging with the fixing frame and including an outer channel, an ejection plate being movably mounted to the guiding frame and comprising a driving end and an ejection tab at two distal ends thereof and a first fulcrum protrusion, a second fulcrum protrusion, and a third fulcrum protrusion between the driving end and the ejection tab, and a handle bar movably retained in the outer channel of the guiding frame and movably engaging with the driving end of the ejection plate;

wherein the ejection plate is rotatably mounted on a portion of the fixing frame, the ejection tab abuts against an inserted card, and the first, second and third fulcrum protrusions sequentially function as a fulcrum of a lever operation to firstly disengage the inserted card from the card connector at a low operating force and then quickly eject the inserted card from the card connector.

7. The card connector as claimed in claim 1, wherein the first, second and third fulcrum protrusions of the ejection plate are linearly arranged.

8. The card connector as claimed in claim 7, wherein the fixing frame is substantially a U-shaped structure comprising two parallel side portions and an intermediate portion guidingly supporting the ejection plate.

9. The card connector as claimed in claim 8, wherein the intermediate portion of the fixing frame defines a first fulcrum hole and a second fulcrum hole and a third fulcrum hole and the first, second and third fulcrum protrusions of the ejection plate are movably retained in the first, second and third fulcrum holes, respectively.

10. The card connector as claimed in claim 9, wherein a positioning plate is provided under the intermediate portion of the fixing frame and defines a first riveting hole, a second riveting hole, and a third riveting hole rivetably engaging with the first, second, and third fulcrum protrusions of the ejection plate, respectively.

11. A multi-fulcrum arrangement of an ejector mechanism in a card connector having a housing thereof, comprising:

a fixing frame adapted to be mounted to the housing;

an ejection plate being movable relative to the fixing frame, said ejection plate defining an ejection tab adapted to be engaged with a card inserted within the connector and a driving end engaged with a driving handle bar; and a first fulcrum positioned adjacent to the ejection tab of the ejection plate and a second fulcrum positioned adjacent to the driving end of the ejection plate; and a third fulcrum being formed between the second fulcrum and the driving end of the ejection plate so as to quicken ejection of the card; wherein the ejection plate is rotated about the first fulcrum, the second fulcrum and the third fulcrum sequentially when actuated by said driving handle bar.

* * * * *